United States Patent [19]

Schröter et al.

[11] 4,023,193

[45] May 10, 1977

[54] PROCESS AND APPARATUS FOR REPLENISHING DEVELOPER IN PHOTOPRINTING MACHINES

[75] Inventors: Herbert Schröter, Taunusstein; Kurt Albrecht Wehlmann, Wiesbaden-Biebrich, both of Germany

[73] Assignee: Hoechst Aktiengesellschaft, Germany

[22] Filed: Dec. 18, 1974

[21] Appl. No.: 533,844

[30] Foreign Application Priority Data

Dec. 21, 1973 Germany ..... 2363757

[52] U.S. Cl. ..... 354/298

[51] Int. Cl.[2] ..... G03D 13/00

[58] Field of Search ..... 354/298, 300, 324; 250/343, 344, 345, 373, 573; 137/2, 93; 356/51

[56] References Cited

UNITED STATES PATENTS

| | | | |
|---|---|---|---|
| 2,296,048 | 9/1942 | Planskoy | 354/298 |
| 2,617,940 | 11/1952 | Giguere | 250/373 |
| 2,674,696 | 4/1954 | Smith et al. | 250/345 |
| 3,597,075 | 8/1971 | Kobayashi | 354/297 X |
| 3,650,196 | 3/1972 | Hosoe et al. | 354/324 |
| 3,712,203 | 1/1973 | Kishi et al. | 354/324 X |
| 3,781,910 | 12/1973 | Herrmann | 250/343 X |

*Primary Examiner*—Fred L. Braun
*Attorney, Agent, or Firm*—James E. Bryan

[57] ABSTRACT

A process for replenishing developing medium in a developing chamber of a photoprinting machine and apparatus for performing the process. The process and apparatus for performing it utilizes at least one photocell in combination with various electrical and optical elements for measuring the concentration of developing medium in the developing chamber, comparing the measured value to a nominal value, and controlling the replenishing of the developing medium correspondingly.

8 Claims, 8 Drawing Figures

PROCESS AND APPARATUS FOR REPLENISHING DEVELOPER IN PHOTOPRINTING MACHINES

Figure 1:
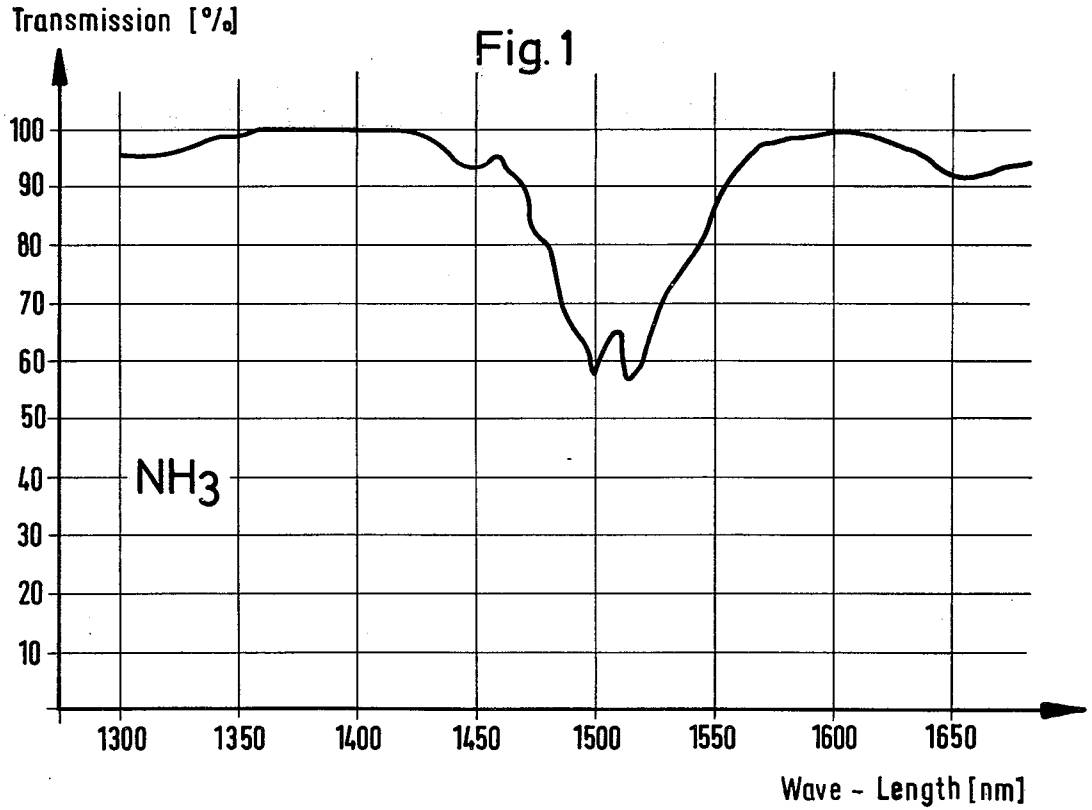

The present invention relates to a process and an apparatus for replenishing developing medium in a developing chamber of a photoprinting machine. The developing medium used in particular is a mixture of ammonia gas and water vapor.

The quality of development of diazotype materials substantially depends on the correct concentrations of developing medium. Various attempts thus have been made in the reproduction field to solve the problems connected with the refilling of developing medium. German Offenlegungsschrift No. 1,522,884, describes a regenerating system in which the regeneration coefficient is determined by measuring the blackness and the surface area of the original with the aid of a single photoelectric cell and using the measured value for controlling the supply of fresh developer solution to be added. This method cannot be used in conventional photoprinting machines because the quantity of developer consumed is substantially independent of the degree of blackness of the original. Instead, the developer consumption is substantially determined by the area of the photoprinting paper to be developed.

For regeneration of the developer in continuous photographic developing machines, it already has been suggested, in German Offenlegungsschrift No. 1,597,650, to control the speed of the motor driving the dosing pump by switching different resistors into the motor circuit, using various switches which are actuated by the material passing through the machine and which are dependent upon the width of the material. Further, it has been suggested, in the same German Offenlegungsschrift, to record the length of the material passing through the machine and to store the values obtained, and to actuate a timer after a predetermined length of material has passed through the machine, so that regenerating material is introduced for an appropriate length of time. This latter method is suitable only for materials of the same width. If materials having different widths and different lengths are alternately used, there arises again the problem of a satisfactory dosage, and in this case it cannot be solved by the possibilities pointed out in the above-mentioned German Offenlegungsschrift.

In German Auslegeschrift No. 1,098,362, a process is described according to which the rate of travel of the material through a photoprinting machine using ammonia is determined by the evaporation speed. In this process, the different widths of the paper to be developed have not been taken into account.

Finally, German Auslegeschrift No. 1,814,980, describes a photoprinting machine in which the developing medium is replenished in dependence upon the material surface to be developed and upon the speed of travel. In this machine, rather exact and correct replenishing are already possible. The material surface to be developed and the speed of travel, however, are only indicative for replenishing developing medium since the consumption of developing medium depends not only upon the material surface to be developed and on the speed of travel of the material. During development of wide materials, for example, less developing gas escapes through the inlet and outlet slots of the developing chamber than during development of narrow materials. Often, too much ammonia is refilled to achieve in any case a sufficient concentration in the developing chamber. This should be prevented, however, since ammonia represents an environmental problem. For this reason, it is important to refill an exact, absolutely necessary quantity.

The object of the present invention thus is to provide a process and a apparatus which permit exact replenishing of developing medium in correspondence with the particular concentration in the developing chamber.

The present invention provides a process for replenishing developing medium in a developing chamber of photoprinting machines, in which the concentration of developing medium in the developing chamber is measured, the measured value is compared to a nominal value, and replenishing of the developing medium is controlled correspondingly.

The present invention further provides an apparatus for the performance of the process with a system for replenishing the developing medium, comprising a light source, at least one light-sensitive element upon which rays of the light source impinge after they have passed a certain layer thickness of developer gas, at least one optical filter arranged between the light source and the light-sensitive element, and at least one comparator, the comparator comparing the signal from the light-sensitive element with a predetermined nominal value for controlling the system for replenishing the developing medium.

When ammonia is used for development, rapid development with good contrast also requires a certain quantity of water vapor. The concentration of at least one of the two components is determined in the developing chamber. Since the developing chamber in most cases also contains air, the concentrations of water vapor and ammonia gas are determined, in a preferred embodiment.

The system for replenishing the developing medium may be a supply container, for example, from which ammonia water is supplied by means of a pump into the vaporizer of the developing chamber or from which ammonia is introduced into the vaporizer by means of a magnetic valve.

The concentration is measured by the reduction of the radiation intensity upon passing through the developing medium. An absorption band characteristic for the developing medium is selected in the wavelength region of which gaseous components possibly still contained in the developing chamber do not absorb. In order to determine the concentration of the developing medium by its absorption, a lamp as the light source with preferably parallel light as well as an optical filter in the light path, and a light-sensitive element, e.g. a photodiode, are provided which preferably are arranged in the developing chamber. If they are arranged outside the developing chamber, care has to be taken only that the rays pass a certain layer thickness of developer gas before they impinge upon the light-sensitive element. In any case, the light path must have the same path length through the developer gas.

The lamp therefore is arranged at a certain distance from the light-sensitive element. In dependence upon the specific concentration of developing medium in the light path, the radiation intensity is correspondingly reduced in the wave-length region characteristic for the developing medium. With a high concentration of developing medium, correspondingly more light is absorbed, i.e. the rays impinging upon the photodiode are weakened so that the photodiode passes only a low signal to the comparator. With a low concentration, however, the photodiode passes a high signal to the comparator. The comparator compares the signal upon the light-sensitive element with a predetermined nominal value which corresponds to the desired concentration. Control of the system for replenishing the developing medium is described below for several individual cases.

For measuring, an optical filter is selected which has its maximum transmission in the wave-length region in which there is a characteristic absorption band of the developing medium. Furthermore, a light-sensitive element is selected the maximum sensitivity of which preferably is in the same wave-length region. The half-width values of the absorption band of the developing medium and of the transmission curve of the filter are of the same order of magnitude. Preferably, the half-width value of the transmission curve of the filter is smaller than the half-width value of the absorption band.

When ammonia gas and water vapor are used as the developing medium, absorption bands of ammonia suitable for the measurement of the invention are at about 1,500 nm, 1,955 nm or 2,265 nm and suitable absorption bands of the water vapor are at 1,360 nm or 1,869 nm, for example.

Since the intensity of the light source may change with time and the values measured are invalidated thereby, the intensity change of the light source is taken into account in a preferred embodiment. For this purpose, an additional optical filter as well as an additional light-sensitive element are provided. The filter is so selected that it has its maximum transmission in a wave-length region in which the developing medium has no absorption bands. The light-sensitive element preferably has its maximum sensitivity in the wave-length region in which the filter has its maximum transmission. The signal measured at the light-sensitive element corresponds to the intensity of the light source. In order to achieve, for concentration measurement, values which are independent of the specific intensity, the signal of the additional light-sensitive element and the signal of the light sensitive element determined for concentration measurement of the developing medium are passed to an electronic element forming the quotient of both signals. The signal of the quotient former is then passed on to the comparator. When the concentrations of several components of the developing medium are measured, e.g. of ammonia gas and of water vapor, two quotient formers are provided; the quotients are formed from the signal of the light-sensitive element coordinated to the ammonia gas and from the signal of the light-sensitive element coordinated to the water vapor with the signal of the light-sensitive element measuring the intensity of the light source. The signals formed thereby are supplied to the comparator coordinated to the corresponding component.

Measurement of the intensity change of the light source does not necessarily require an additional light-sensitive element. It is also possible, for intensity measurement of the light source, to use the same light-sensitive element with which the concentration of the ammonia gas is measured. In this case, however, care must be taken that the signals impinge upon the light-sensitive element one after the other. This is achieved by the use of a rotatable disc with filters.

For measuring the concentrations of several components, e.g. of ammonia and water vapor, there is used a filter for each component. The one filter has its maximum transmission in the wave-length region in which is the selected characteristic absorption band of the ammonia and the other filter has its maximum transmission in the wave-length region in which is the selected characteristic absorption band of the water vapor. It is possible to provide a light-sensitive element for each component, each light-sensitive element passing the signal to its coordinated comparator for the purpose of comparing it with the corresponding nominal value, whereby replenishing is correspondingly controlled. In this case also, it is recommended to take into account the intensity change of the light source in that the signals of the light-sensitive elements are first supplied to a quotient former and only then to the corresponding comparator. Furthermore, as mentioned above, it is possible to use only one light-sensitive element for both components, if a rotatable disc with filters is used and the signals produced in the light-sensitive element are alternately supplied to one of the comparators or first to one of the quotient formers.

As mentioned above, control of replenishing of the developing medium in the case of a deviation of the measured value from the given nominal value depends upon the specific embodiment. In the simplest case, the developer medium used is composed of one component. If the signal measured at the photodiode is above the nominal value, developing medium is refilled since the concentration in the developing chamber is too low. Developer medium is refilled until the measured value and the nominal value are identical. If, however, the measured signal and the nominal value are identical, the developing chamber has the desired concentration and replenishing thus is not necessary. If the measured signal is lower than the nominal value, i.e. the concentration is too high, also no developing medium is refilled.

In the following, there will be described the various cases with the use of a mixture of ammonia gas and water vapor as the developing medium with the assumption that the concentration of air in the developing chamber is so low that it may be neglected. If ammonia water (e.g. 25 percent) is used for replenishing and only the ammonia concentration is measured, no ammonia water will be refilled, as far as the measured signal and the nominal value are identical or the measured signal is smaller than the nominal value, since the developing chamber contains sufficient ammonia. If, however, the measured signal is above the nominal value, ammonia water is refilled into the vaporizer of the developing chamber. If instead of the ammonia concentration the water vapor concentration is measured, no ammonia water is added in this case also, as far as the measured signal and the nominal value are identical. If the measured signal is above the nominal value, i.e. the water concentration is too low, no developer is added in this case also. If ammonia water were refilled in this case, the ammonia concentration would further increase since ammonia, as the more volatile constituent of the ammonia water, would first be released and the water would evaporate only after a relatively long dwell time at the temperature of the vaporizer. In order to again achieve the desired nominal value of the water concentration, no fresh ammonia water may be added. Without an addition, the water concentration will again increase since the ammonia water already contained in the vaporizer will give off more water with an increasing dwell time since the volatile ammonia is expelled first. If, however, the measured signal is smaller than the nominal value, i.e. the water concentration is too high, ammonia water must be added from which ammonia, as the more volatile constituent, evaporates first and thus dilutes the water vapor contained in the developing chamber.

If the components ammonia gas and water vapor are not replenished in the form of ammonia water but individually, e.g. by adding gaseous ammonia and water vapor, the following cases are to be distinguished. If only one component is measured, e.g. ammonia, no addition is made, if the measured signal and the nominal value are identical, and ammonia is added if the measured signal is above the nominal value, and finally water is added if the measured signal is smaller than the nominal value. The conditions are reversed if, instead of the ammonia concentration, the water vapor concentration is determined. In both cases, the signal measured at the light-sensitive element is passed to two comparators. The first comparator is so switched that it responds only when the nominal value is exceeded and, in the first case, controls replenishing of the ammonia and, in the second case, controls replenishing of the water vapor. The second comparator responds only in the case of a falling below the nominal value, i.e. in the first case it controls replenishing of the water vapor and in the second case replenishing of the ammonia.

Finally, there is the case in which, as just mentioned, both components are refilled separately, but the ammonia gas concentration as well as the water vapor concentration are determined in the developing chamber. In this case, ammonia is replenished when the light-sensitive element coordinated to the determination of ammonia measures a higher signal, whereas no addition is made when the values are identical or when the value is below the nominal value. Water vapor is replenished when the light-sensitive element coordinated to the determination of water vapor measures a higher signal as the nominal value, whereas no addition is made when the values are identical or the value is below the nominal value.

Figure 2:
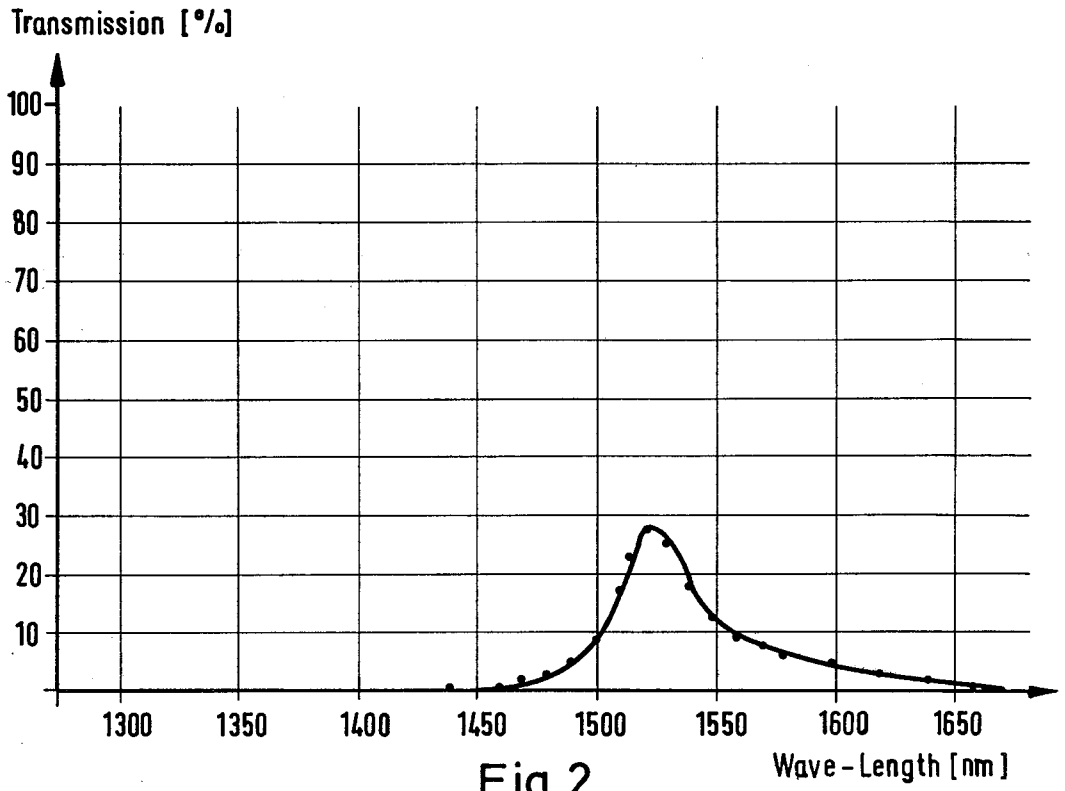
Figure 3:
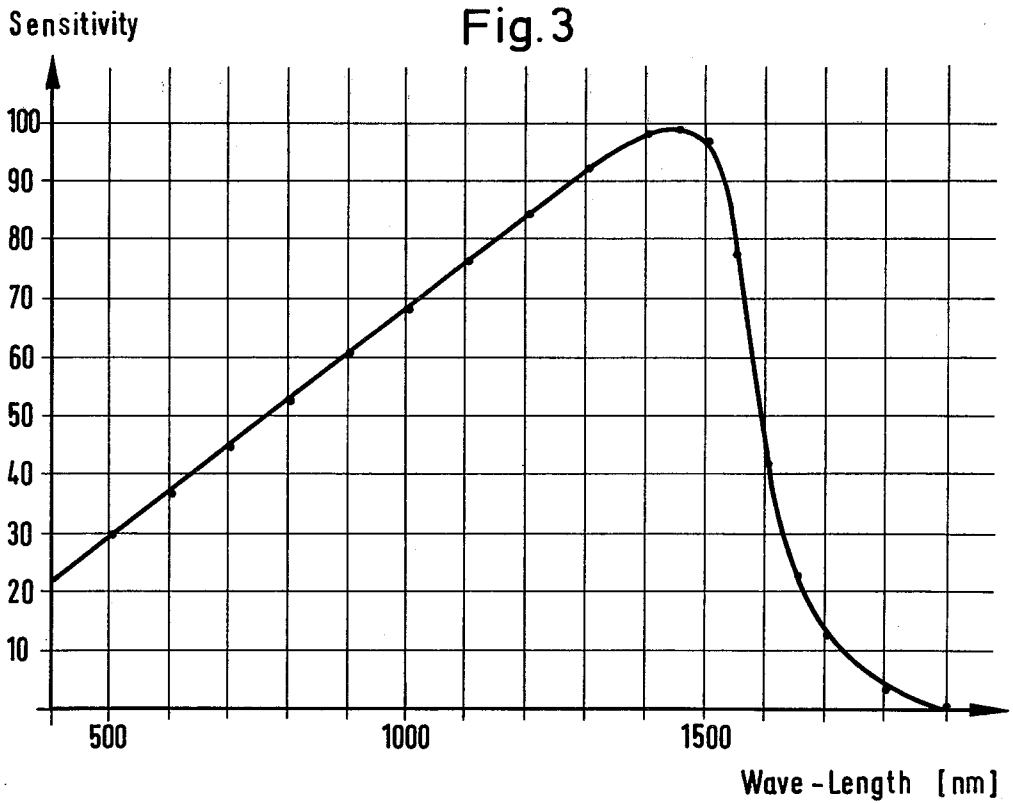
Figure 4:
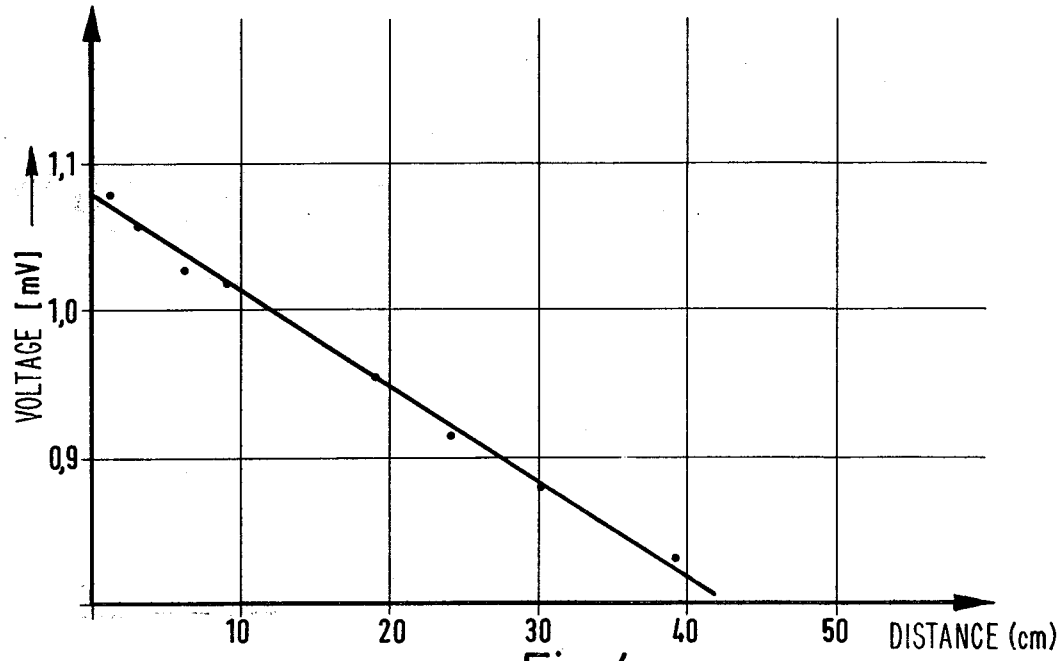
Figure 5:
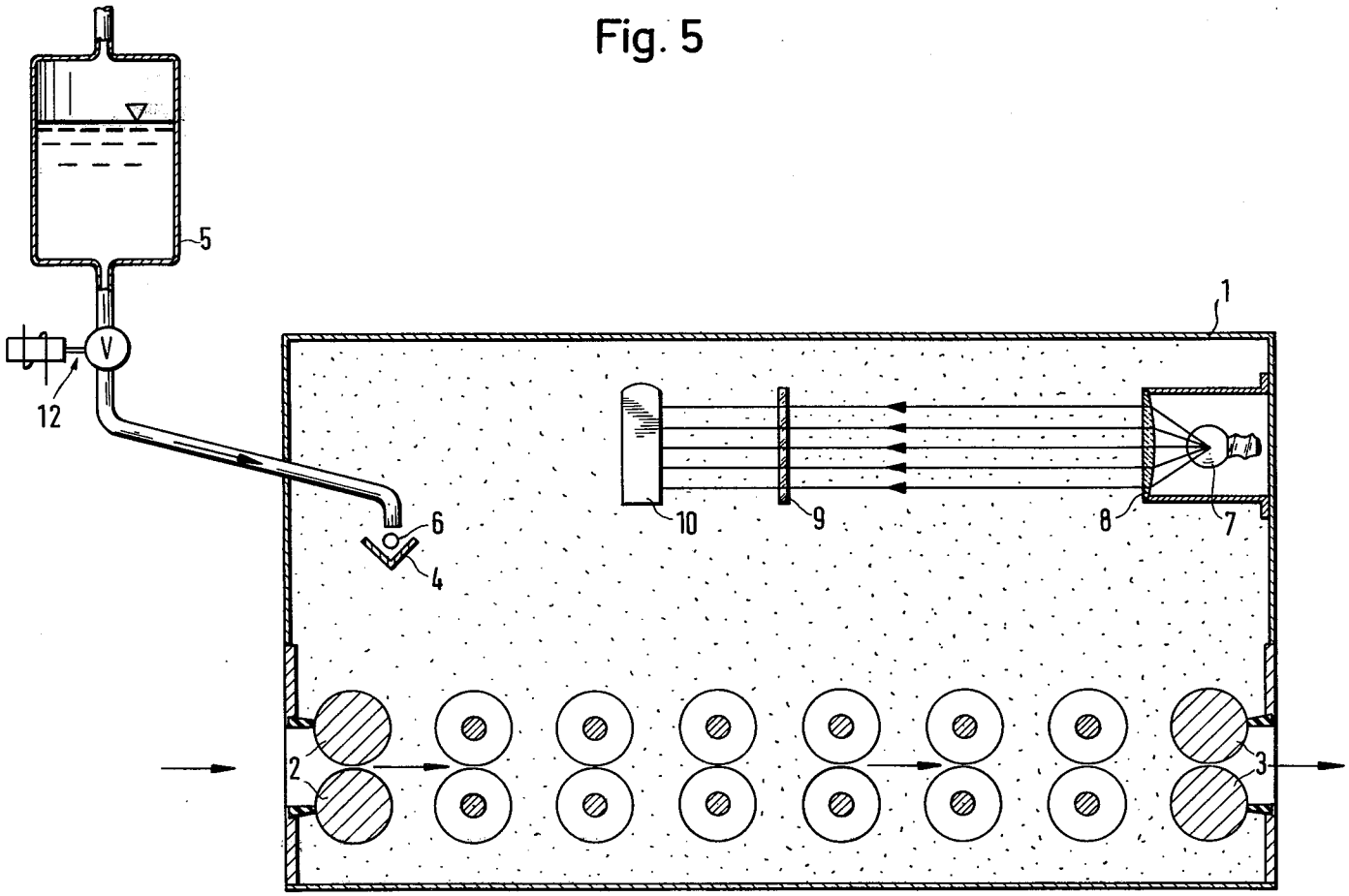
Figure 6:
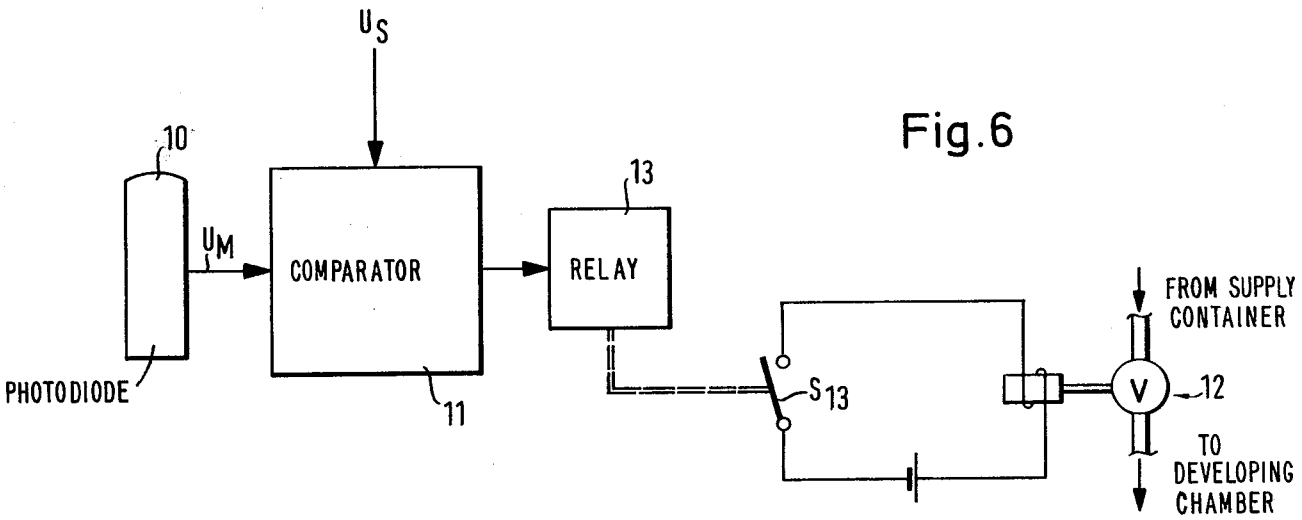
Figure 7:
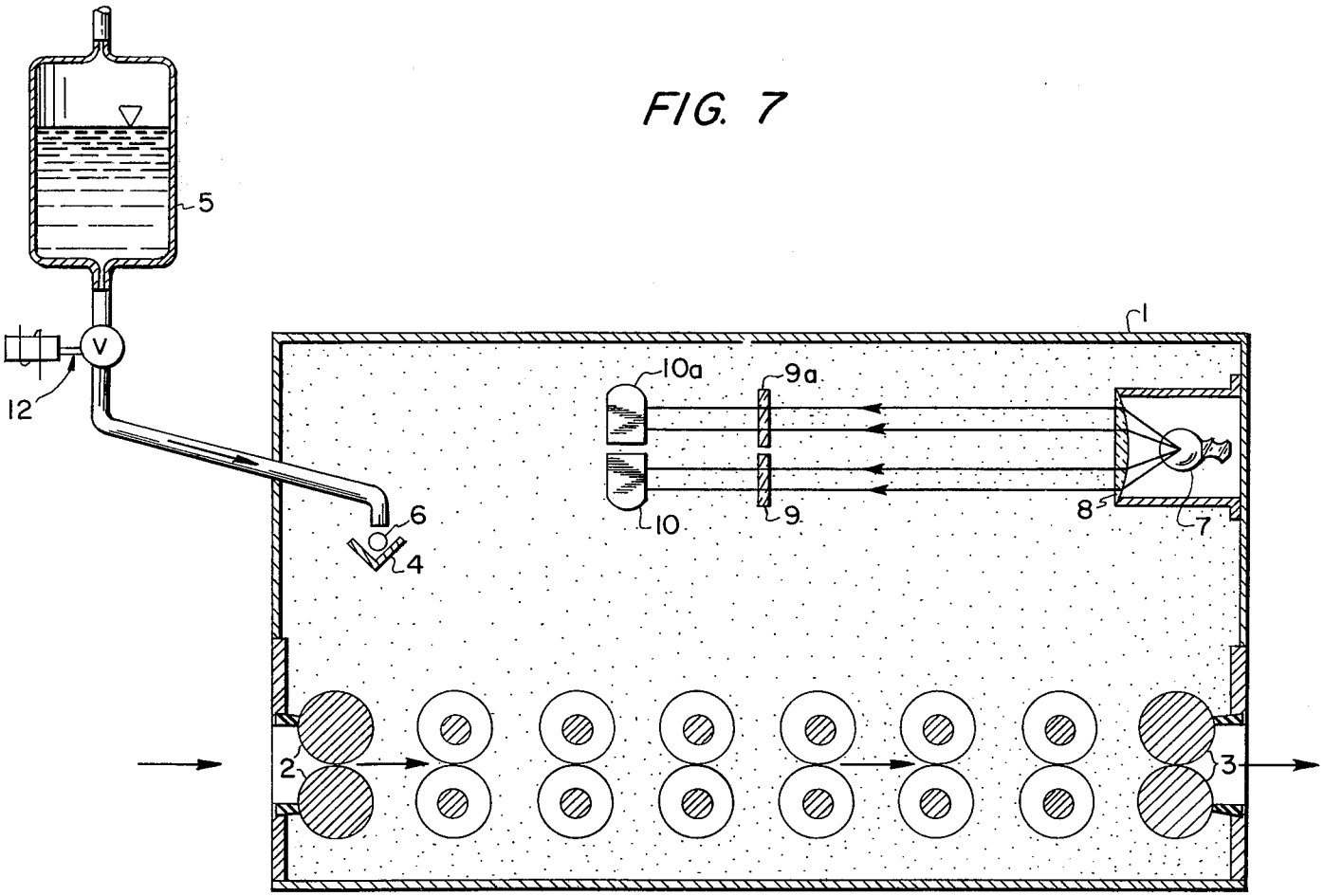
Figure 8:
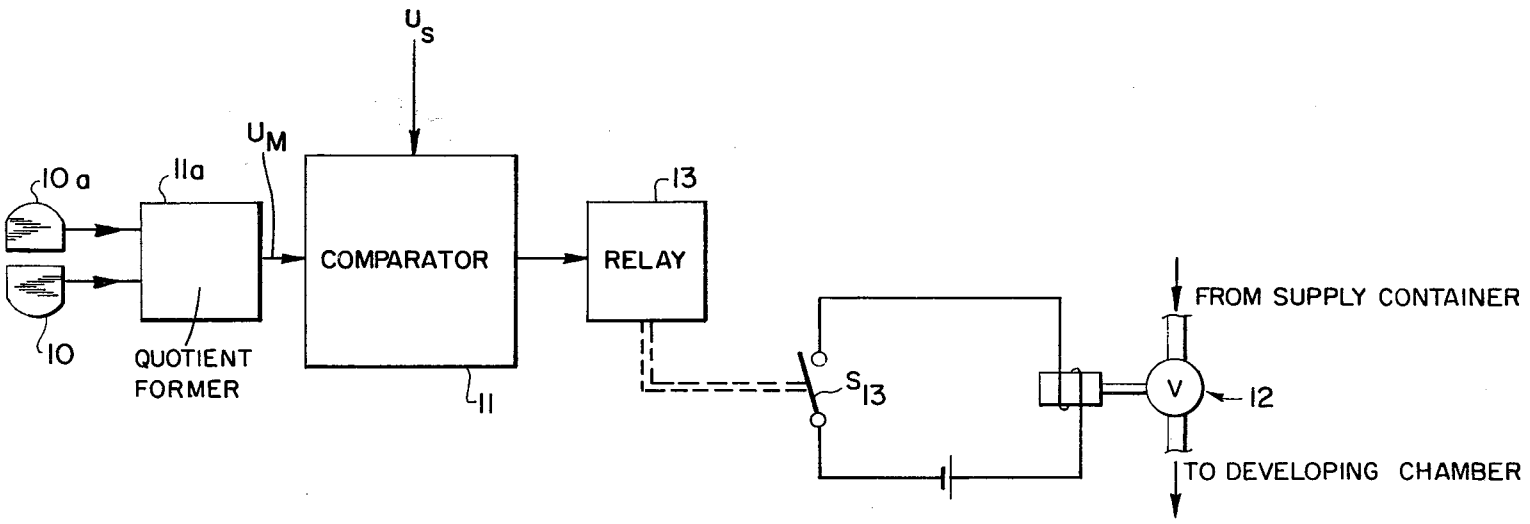

The invention will be further illustrated by reference to the accompanying drawings, in which:

FIG. 1 shows the absorption spectrum of the ammonia in the wave-length region which can be used for measuring the concentration, FIG. 2 shows the transmission curve of the filter, FIG. 3 shows the sensitivity curve of the light-sensitive element, FIG. 4 shows a curve representing the dependence between the measuring path and the voltage produced at the photodiode, if the measuring path is completely filled with $NH_3$ gas, FIG. 5 is a diagrammatic sectional view of an embodiment of the apparatus of the invention, FIG. 6 is a circuit diagram of the embodiment shown in FIG. 5, FIG. 7 is a diagrammatic sectional view of a modified embodiment of the apparatus of FIG. 5, and FIG. 8 is a modified circuit diagram of the embodiment shown in FIG. 6.

FIG. 1 shows the absorption band of ammonia at 1,500 nm, which is used for measuring the concentration in the exemplary embodiment. FIG. 2 shows the transmission curve of the IR interference filter used (Messrs. Schott, Mainz, Germany). The half-width value of this curve is about 38 nm and is thus smaller than that of the ammonia absorption band at 1,500 nm (about 63 nm). As can be seen from FIG. 3, the photodiode used has its maximum sensitivity at about 1,500 nm. In FIG. 4, the voltage at the photodiode is plotted logarithmically against the distance covered by the light in the developer gas. The curve appears correspondingly when, as in the case of the apparatus of the invention, the distance of the light through the developer gas is kept constant and, instead, the concentration of the developer gas is increased. The higher the concentration, the lower the voltage is at the photodiode.

FIG. 5 shows a developing chamber 1 with a pair of feed rolls 2 and a pair of delivery rolls 3 for the material to be developed. In the developing chamber 1, there is a vaporizing channel 4 into which the ammonia water is dropped from the supply container 5. The vaporizing channel 4 contains a heating rod 6 for vaporizing the ammonia water. For determining the ammonia concentration, the developing chamber 1 contains a lamp 7, the light of which is made parallel by means of the lens 8. The light passes through the IR interference filter 9 which has a transmission curve as shown in FIG. 2. After the light has passed through the filter 9, it impinges upon the photodiode 10. The filter 9 may be arranged at any place between the light source 7 and the photodiode 10. The distance between the photodiode 10 and the light source 7 is predetermined since, in the case of a change of the distance, the signal at the photodiode would be changed correspondingly.

As shown in FIG. 6, the signal $U_M$ of the photodiode 10 is passed to the comparator 11 which compares the signal $U_M$ with a predetermined nominal value $U_S$. The nominal value corresponds to the desired ammonia concentration in the developing chamber 1. The comparator 11 is so switched that it only has one signal at its output when $U_M$ is above $U_S$. When $U_M$ and $U_S$ are identical, i.e. when the desired concentration of ammonia is in the developing chamber, the comparator 11 passes on no signal. This also is the case when $U_M$ is smaller than $U_S$, i.e. the concentration in the developing chamber 1 is higher than the desired concentration, e.g. when too much ammonia water has been added by hand. Usually, the system for replenishing (supply container 5 and magnetic valve 12) is so selected that, with automatic replenishing according to the invention, substantial exceeding of the desired concentration value of ammonia does not occur.

The comparator 11 passes a signal to the relay 13 only when the measured signal $U_M$ is above the nominal value $U_S$, i.e. the ammonia concentration has fallen below the desired value. The relay 13 then closes the switch $S_{13}$ whereby the circuit is closed and the magnetic valve 12 is actuated. Ammonia water drops from the supply container 5 into the vaporizing channel 4. Consequently, the ammonia concentration in the developer chamber 1 increases. The signals $U_M$ measured at the photodiode 10 will then decrease. As soon as $U_M$ has reached the nominal value $U_S$ no signal is emitted at the output of the comparator 11, i.e. the relay 13 is not energized, the switch $S_{13}$ is open and thus no ammonia water is refilled. Only when, due to the ammonia consumption by the development of materials or by an escape through the pairs of rollers 2 and 3, the ammonia concentration decreases again, i.e. the light intensity of the lamp 7 is reduced less and thus the signal $U_M$ increases above the nominal value $U_S$, is the magnetic valve 12 again actuated.

FIG. 7 shows an additional filter 9*a* and an additional light-sensitive element 10*a*, and FIG. 8 shows the additional light-sensitive element 10*a* and an electronic element for quotient formation 11*a*.

It will be obvious to those skilled in the art that many modifications may be made within the scope of the present invention without departing from the spirit thereof, and the invention includes all such modifications.

What is claimed is:

1. A process for replenishing developing medium composed of ammonia gas and water vapor in a developing chamber of a photoprinting machine, which comprises measuring the concentration at least one component of the developing medium in the developing chamber by determining the transmission of the developing medium in a wavelength region of infra-red, generating an electrical signal corresponding to said transmission, comparing said electrical signal with a predetermined electrical value, and controlling the replenishing of the developing medium corresponding to the difference of the said electrical signal corresponding to said transmission and said predetermined electrical value.

2. A process according to claim 1 in which the concentration of ammonia gas is measured by determining the transmission of the developing medium in a wavelength at about 1,500 nm, 1,955 nm, or 2,265 nm.

3. A process according to claim 2 in which the concentration of water vapor is measured by determining the transmission of the developing medium in a wavelength region at about 1,360 nm or 1,869 nm.

4. An apparatus for replenishing developing medium in a developing chamber of a photoprinting machine comprising a developing chamber having a developer gas therein, a light source, at least one light-sensitive element upon which rays from the light source impinges after passing a certain layer thickness of said developer gas, at least one optical infra-red filter mounted between the light source and the light-sensitive element, at least one electrical comparator means for comparing an electrical signal from the light-sensitive element with a predetermined nominal electrical value, and means controlled by said comparator means for replenishing developing medium in said chamber.

5. An apparatus according to claim 4 including lens means between the light source and the optical filter, which lens means parallelizes the rays of the light source.

6. An apparatus according to claim 4 in which the optical filter has a maximum transmission and the light-sensitive element a maximum sensitivity in the wavelength region in which the developing medium has a characteristic absorption band, and the half-width value of the transmission curve of the optical filter and the half-width value of the absorption band are of the same order of magnitude.

7. An apparatus according to claim 4 including an additional optical filter and an additional light-sensitive element, the filter having a maximum transmission in a wave-length region in which the developing medium has no absorption bands and the light-sensitive element having its maximum sensitivity in the said wave-length region, and further including an electronic element for quotient formation of the signal of the additional light-sensitive element and of the signal of the light-sensitive element measuring the absorption of the developing medium.

8. An apparatus according to claim 4 in which the means for replenishing the developing medium includes a supply container and a magnetic valve.

* * * * *

UNITED STATES PATENT AND TRADEMARK OFFICE

CERTIFICATE OF CORRECTION

PATENT NO. : 4,023,193

DATED : May 10, 1977

INVENTOR(S) : Herbert Schröter and Kurt Albrecht Wehlmann

It is certified that error appears in the above-identified patent and that said Letters Patent are hereby corrected as shown below:

Column 7, line 16, after "concentration" the word - - - of - - - has been omitted and should be inserted thereat.

Column 7, line 30, after "length" the word - - - region - - - has been omitted and should be inserted thereat.

Column 8, line 3, "pinges" should read - - - pinge - - -.

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*